United States Patent [19]

Majors et al.

[11] 4,258,507

[45] Mar. 31, 1981

[54] FLUID HEATED ANNULAR VIBRATING FINISHING APPARATUS

[76] Inventors: Curtis O. Majors, 7918 Winterberry Pl., Cincinnati, Ohio 45241; Robert L. Majors, 690 Reynard, Cincinnati, Ohio 45231

[21] Appl. No.: 70,787

[22] Filed: Aug. 29, 1979

[51] Int. Cl.[3] ..... B24B 31/00

[52] U.S. Cl. ..... 51/163.2; 51/314

[58] Field of Search ..... 51/7, 163.1, 163.2, 51/314

[56] References Cited

U.S. PATENT DOCUMENTS

| | | | |
|---|---|---|---|
| 707,159 | 8/1902 | Ridlon | 51/314 |
| 1,887,026 | 11/1932 | Lach | 51/314 |
| 3,268,177 | 8/1966 | McKibben | 51/163.2 |
| 3,990,188 | 11/1976 | Balz | 51/7 |
| 4,177,608 | 12/1979 | Balz | 51/163.2 |

*Primary Examiner*—Harold D. Whitehead

*Attorney, Agent, or Firm*—Wood, Herron & Evans

[57] ABSTRACT

An annular vibrating finishing apparatus including an annular tub mounted on a floating support. A gyrating motion-producing shaft extends upwardly through the central opening in the tub and interconnects a motor and the tub. A metal jacket surrounds the tub and forms a chamber for circulating a heated fluid around the lower, exterior section of said tub. This provides heat to the workpieces and finishing media and causes the workpieces to dry more rapidly during the finishing process.

2 Claims, 3 Drawing Figures

FLUID HEATED ANNULAR VIBRATING FINISHING APPARATUS

BACKGROUND OF THE INVENTION

The present invention relates to a floating vibrating finishing machine having an annular tub with a curvilinear bottom wall and, more particularly, relates to such an apparatus having a means to heat the annular finishing tub by circulating a heated liquid around the exterior of the tub.

PRIOR ART

Vibratory finishing machines with annular tubs are well known in the art and have been the subject of numerous patents. These machines are one of several types of machines used to finish castings and molded products by deburring, burnishing or polishing. Typical of the patents describing such machines are U.S. Pat. Nos. 2,882,024; 3,400,495; 3,435,564; 3,990,188 and 4,026,075. Other types of finishing machines include rotating drums and vibrating tubs.

Vibratory finishing machines generally include a finishing chamber or tub adapted to hold the parts to be finished together with an abrasive finishing or drying material. The workpieces and finishing material are vibrated and subsequently workpieces are discharged while the finishing media is retained in the machine. The relative motion of the finishing media and the workpieces causes the workpieces to be abraded and finished. Usually, the workpieces are wet when being abraded and finished. Therefore, prior to further handling, it is desirable that the finished workpieces be dried. In the past, the heat has been supplied to floating vibratory finishing machines by mounting infrared heaters above the tubs. This has caused several potential hazards, such as the possibility of fire, and the possibility that a workman may suffer serious burns. In addition, such infrared heaters are disadvantageous since they require an objectionable amount of space.

OBJECTS OF THE INVENTION

The principal object of the present invention is to provide an improved vibratory floating tub-type finishing machine especially adapted for rapidly drying workpieces and including means to heat the workpieces and drying material during the drying operation so that the workpieces are dried in a minimum amount of time.

Another object of the present invention is to provide a vibratory floating tub-type finishing machine in which a heated fluid is passed in heat exchange relationship with the tub to supply the heat for drying the workpieces.

A still further object of the present invention is to provide an improved vibratory floating tub-type finishing machine including means for heating the tub which do not increase the size of the machine or the power required to operate it.

A still further object of the present invention is to provide a vibratory floating tub-type finishing machine including means for heating the workpieces and finishing materials which is both safe and economical.

SUMMARY OF THE INVENTION

The present invention is predicated upon the concept of constructing a finishing machine comprising an annular tub with a curvilinear bottom and a sealed hot water circulating chamber surrounding a portion of the curvilinear bottom of the tub. This latter chamber is provided with inlet and outlet fittings connected to conduits for circulating water from a heater through the chamber. This water is heated to a temperature of the order of 200° F. We have empirically determined that water at even this relatively low temperature and in heat transfer relationship with only a small portion of the tub wall is nevertheless efficient to dry workpieces during a normal finishing cycle. We believe that this highly effective drying action is due in part to the fact that the water in the water circulating chamber is not only flowing around the tub, but also is being gyrated to provide for a heat transfer of optimum efficiency.

In one preferred form of the present invention, the annular tub is mounted above a floating support plate. The tub is gyrated by means of a shaft carrying eccentric weights which extends upwardly through an aperture in the plate and a central opening in the tub, the shaft being connected to an inner wall of the tub.

A depending skirt is mounted around the lower periphery of the tub. This skirt is welded or otherwise joined to the tub and to the mounting plate, and the plate is similarly joined to the bottom of the tub to form a fluid-tight water circulating chamber. This chamber is fitted with both inlet and outlet fittings for connection to a hot water circulating pump and heater.

In addition to the effective drying of the workpieces provided by our novel vibratory finishing machine, it is advantageous in that it is safe and economical to construct and operate. Moreover, it does not increase either the overall size of the machine or the size of the motor required to operate it.

These and other objects and advantages of the present invention will be more readily appreciated from a consideration of the following detailed description of the drawings illlustrating a preferred embodiment of the invention.

DETAILED DESCRIPTION OF THE INVENTION

Figure 1:
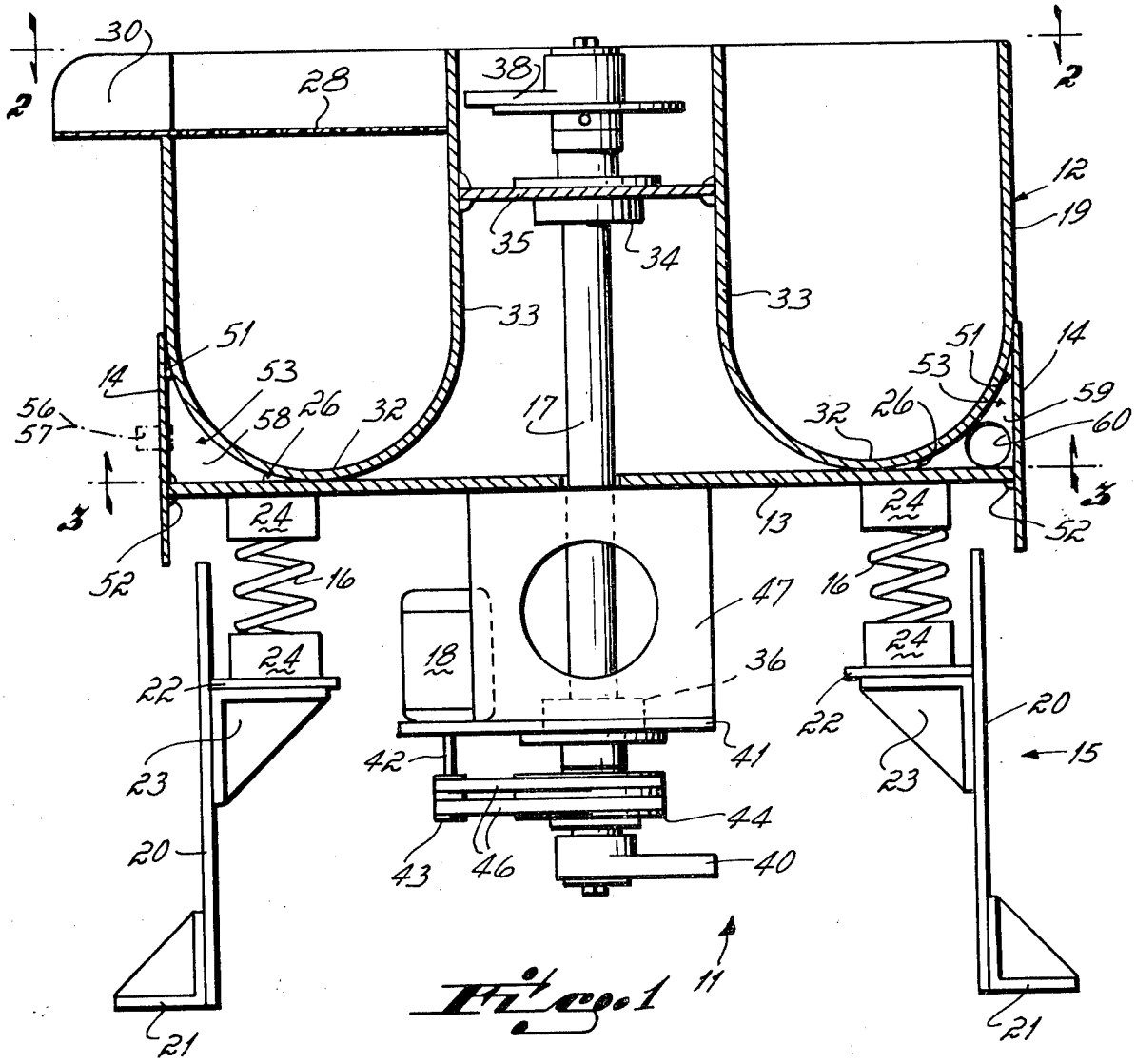
FIG. 1 is an axial cross-sectional view of a finishing apparatus according to this invention.

The overall construction of a vibrating finishing machine embodying the present invention is shown in FIG. 1. As there shown, the vibrating finishing machine comprises an annular work tub 12 which has a curvilinear bottom wall 32 and an upstanding peripheral wall 19. The tub 12 is mounted on a circular support plate 13 and is surrounded by a metal sleeve 14. The support plate is resiliently mounted on stationary base 15 by means of a plurality of springs 16 and thus forms a floating support for tub 12. The annular tub 12 surrounds, and is attached to, an eccentrically weighted shaft 17 which is rotated by a motor 18, thus causing the annular work tub 12 to vibrate or gyrate in a manner well known in the art.

The base 15 upon which the finishing apparatus 11 rests includes an upstanding cylindrical wall 20 to which footplates 21 are secured. An inwardly, radially disposed flange 22 is mounted upon an intermediate portion of base wall 20 by a plurality of gussets 23. The lower ends of springs 16, which provide a resilient mounting for base plate 13 and work tub 12, are mounted upon flange 22 by means of cups 24. The springs are attached to the bottom of base plate 13 by means of similar cups.

Figure 2:
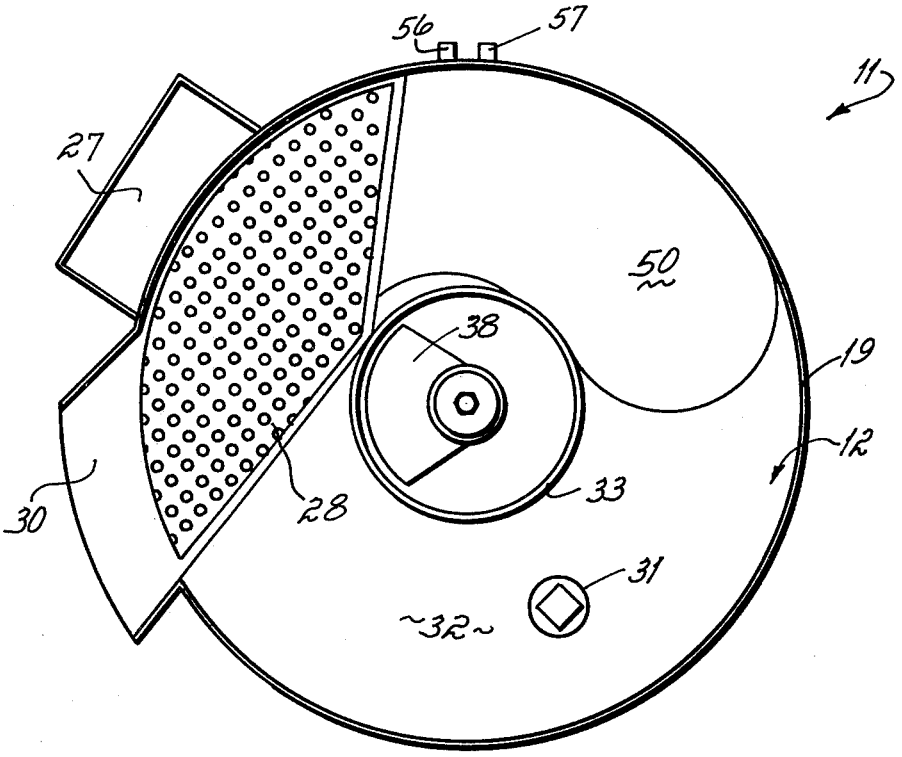
FIG. 2 is a top plan view of the finishing apparatus taken along line 2—2 of FIG. 1.
Figure 3:
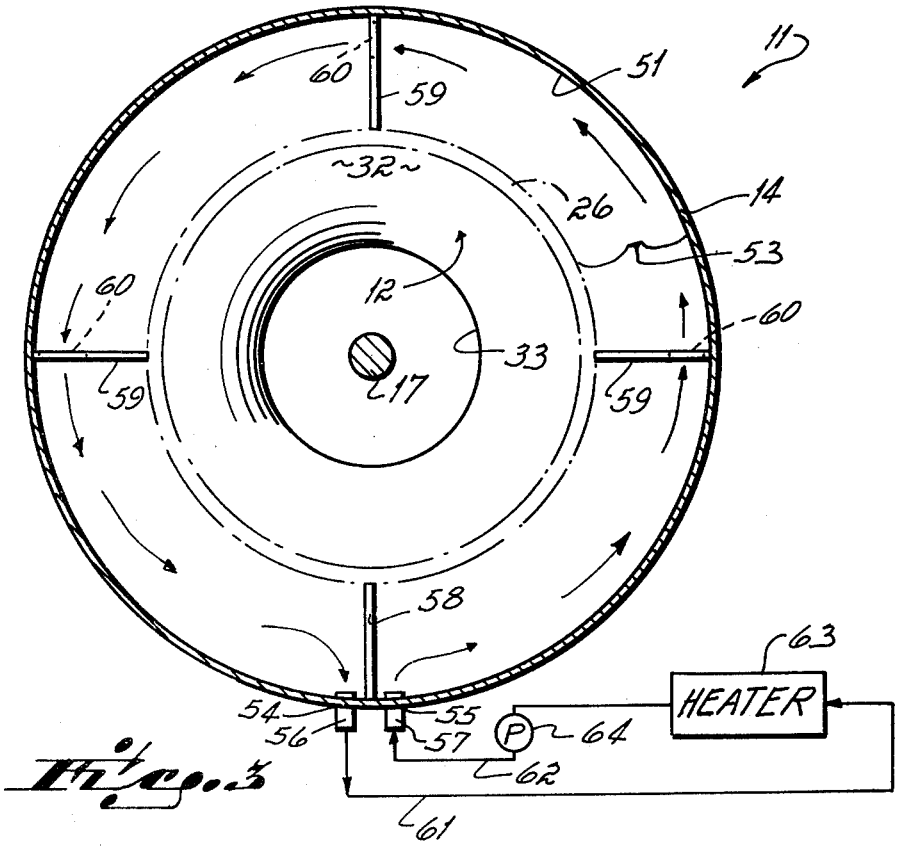
FIG. 3 is a cross-sectional view of the finishing apparatus taken at line 3—3 of FIG. 1.

The support plate 13 is a rigid circular plate with a central opening. The curvilinear bottom of the annular tub 12 rests upon, and is welded to, the support plate 13 as at 26 and this weld 26 forms a continuous water-tight seal between the annular tub and the base plate. (See FIG. 2)

Tub 12 is provided with an internal ring 50 positioned on the bottom of the tub for directing the workpieces and the finishing material upwardly. This facilitates removal of workpieces from the tub and separation of the finishing material from the workpieces. When the finishing process has been completed, a screening member 28 is placed in alignment with the ramp and an exit slot 30. The screening member retains the workpieces which are advanced to the exit slot, while the finishing material, such as ground cobs, falls back into the tub.

The annular tub is provided with a chute 27 located beneath the screening member 28 and exit slot 30. Articles to be finished are fed to the tub through the entrance chute 27. As the articles are vibrated, they travel in the finishing media around the annular tub and up ramp 50, over screening member 28, and out the exit slot 30. The tub is also provided with a plug 31 to drain contents thereof.

The vibrational motion is imparted to the annular tub by means of an eccentrically weighted rotating shaft 17. This shaft extends upwardly through the central opening of the tub and is attached, as by welding, to the inner wall 33 of the tub. The upper portion of shaft 17 is journalled in a bearing 34 mounted at the center of a round plate 35 which is welded to the inner wall 33 of the annular tub. The lower portion of the shaft is journalled in a second bearing 36 carried by a bottom plate 41 of the cylindrical motor mount 47 which in turn is rigidly affixed to the lower side of support plate 13. Attached to the ends of the shaft are weights 38 and 40 which are 180° out of phase with each other.

A variable speed electric motor 18 is mounted to the outer wall of the cylindrical motor mount 47. The motor shaft 42 carries a pulley 43 which is connected by means of endless flexible belts 46 to a second pulley 44 mounted on shaft 17. As the motor drives shaft 17 to rotate, the out-of-phase weights 38 and 40 rotate, causing the annular tub to vibrate.

In accordance with the present invention, a sleeve or jacket 14 is mounted around the lowermost portion of tub 12. The sleeve is attached to the tub and the support plate by means of continuous welds 51 and 52 which form water-tight seals. Thus, a sealed space 53 (hereinafter referred to as the heat chamber) is formed surrounding the outer, lower surface of the curvilinear bottom wall 32 of the annular tub and above the support plate 13. Two aperatures 54 and 55 with hose fittings 56 and 57 are located in sleeve 14 closely adjacent to one another. The fittings 56 and 57 are separated by an internal flange 58 which forms a barrier, preventing fluid from flowing directly between the hose fittings. Other reinforcing gussets 59 are located within the heat chamber 53. These additional gussets, which support the annular tub, are provided with openings 60 to allow liquid to flow through the gusset and around the heat chamber.

Hoses 61 and 62 are attached to fittings 56 and 57 and interconnect these fittings with a water heater 63 and a water pump 64 located near the finishing apparatus. In a preferred embodiment, the water heater is effective to heat water to a suitable temperature, which in the preferred embodiment is approximately 200° F. In this embodiment, pump 64 is effective to circulate water at a rate of approximately 840 gallons per hour.

In operation, as the articles are being finished within the vibratory work bowl, heated water is circulated through hose 61, around the heat chamber 53, and out fitting 57. The water is returned back through hose 62 to the heater and pump to be reheated and recirculated. The heated water heats the wall of tub 12 and thus the finishing material and workpieces, causing the workpieces to dry during the finishing process.

We have empirically determined that the present finishing machine is effective to dry workpieces rapidly and efficiently; and is completely safe in operation. Moreover, no increase in the size or power or motor 18 is required due to the presence of the relatively small volume of liquid in chamber 53. The overall size of the vibrating machine is not increased and the cost of adding the workpiece heating means is minimal.

The preferred embodiment described in this application has been described by way of example. It will be understood by those skilled in the art that various modifications can be made without departing from the spirit and scope of the invention as defined by the appended claims. Thus, for example, it is contemplated that if in a particular installation even more rapid drying is desired than is provided by the hot water system described, steam can be circulated through the heat chamber 53. Also, while the present machine when used with a drying material accomplishes only a superficial finishing operation effective to remove water marks and the like, it is contemplated that the present invention can be incorporated in heavy duty finishing equipment in which substantial abrasion occurs. In such machines the work bowl is lined to resist abrasion as is well known to those skilled in the art.

Having described our invention, we claim:

1. A heated annular vibrating finishing machine comprising:

a fixed base;

a support plate resiliently mounted upon said fixed base;

an annular tub with an outer wall and a curvilinear bottom wall rigidly mounted upon said support plate by means of a fluid-tight seal;

a sleeve surrounding said support plate and annular tub, said sleeve being rigidly joined to the outer wall of said tub in fluid-tight relationship;

a fluid-tight heating chamber defined by said sleeve, said base plate and the curvilinear wall of said annular tub;

said fluid-tight heating chamber being completely sealed from the interior of said tub;

fluid inlet and outlet connections to said heating chamber for recirculating heated fluid through said heating chamber; and means to impart vibrational motion to said annular tub.

2. The vibrating finishing machine of claim 1 in which said means for imparting a vibrating motion to said tub includes a shaft extending upwardly through a central opening in said annular chaft and said heating chamber is disposed about the outer periphery of said curvilinear bottom wall.

* * * * *